United States Patent [19]

Takeda et al.

[11] Patent Number: 4,580,430

[45] Date of Patent: Apr. 8, 1986

[54] TORSIONAL MOLDING APPARATUS FOR CRANK SHAFT

[75] Inventors: Kunio Takeda; Nobuyoshi Nagatsuma, both of Kawagoe; Tetsuo Kannonji, Fujimi; Haruo Meguro, Sayama, all of Japan

[73] Assignee: Honda Giken Kogyo Kabushiki Kaisha, Japan

[21] Appl. No.: 631,123

[22] Filed: Jul. 16, 1984

[30] Foreign Application Priority Data

Jul. 15, 1983 [JP] Japan ..... 58-128938

[51] Int. Cl.[4] ..... B21K 1/08; B21D 11/16

[52] U.S. Cl. ..... 72/299; 72/310; 72/311; 72/452; 72/300; 29/6

[58] Field of Search ..... 72/299, 298, 310-315, 72/300, 371, 452, 417, 125, 465; 29/6

[56] References Cited

U.S. PATENT DOCUMENTS

| | | | |
|---|---|---|---|
| 1,274,390 | 8/1918 | Damerell | 72/299 |
| 1,909,097 | 5/1933 | Damerell | 72/299 |
| 2,018,931 | 10/1935 | Swanson et al. | 29/6 |
| 2,414,549 | 1/1947 | Nowak | 29/6 |
| 2,856,876 | 10/1958 | Watter | 72/465 |

FOREIGN PATENT DOCUMENTS

| | | | |
|---|---|---|---|
| 437895 | 12/1926 | Fed. Rep. of Germany | 72/298 |
| 661408 | 11/1951 | United Kingdom | 72/298 |

*Primary Examiner*—Daniel C. Crane

*Attorney, Agent, or Firm*—Armstrong, Nikaido, Marmelstein & Kubovcik

[57] ABSTRACT

A torsional molding apparatus for arranging each crank pin of a crank shaft at a predetermined angular position wherein a plurality of crank pins are arranged on the same plane passing through an axis of the crank shaft. The apparatus comprises posts on a fixed support bed, a vertically movable cushion bed, a vertically movable bed arranged above the cushion bed, a fixed lower mold and a fixed upper mold secured to the cushion bed and vertically movable bed, respectively, a rotatable lower mold and a rotatable upper mold rotatably carried on the cushion bed and vertically movable bed rotatably about the axis of the crank shaft, and arms integrally and outwardly projected from the rotatable lower mold and placed in abutment with the upper ends of the posts.

5 Claims, 7 Drawing Figures

V
VI
7
23
9
31
34
36
32
24a
24c
11a
13a
38
40
26
26
P1
P2
B1
28
B1
B3
45
13
IV
IV
11
44
42
B2
J1
27
J2
P3
43
12
10
37
39
12a
1
29
10a
30
25
47
25
17a
33
48
35
18c
5
18a
8
49
50
21a
21c
22a
22c
VI
56
6
55
17c
53
54
20a
51
52
20c
16
2
V

TORSIONAL MOLDING APPARATUS FOR CRANK SHAFT

BACKGROUND OF THE INVENTION

1. Field of the Invention

The present invention relates to a torsional molding apparatus for arranging each crank pin of a crank shaft at a predetermined angular position wherein a plurality of crank pins are arranged on the same plane passing through an axis of the crank shaft.

2. Description of the Prior Art

In conventional torsional molding apparatuses of the above type, a crank shaft is clamped between clamp arms or split molds for torsional molding. These apparatuses are, however, used only for torsion operation and have a large size. A torsional force is obtained by a cylinder or the like means provided separately from a driving source for clamping operation, and therefore, the structure inevitably becomes complicated.

SUMMARY OF THE INVENTION

The present invention has been proposed for overcoming the disadvantages noted above inherent to prior art devices and has as its object the provision of a torsional molding apparatus for crank shaft which can simplify and miniaturize the structure by enabling a single mechanism to serve both as a clamping mechanism and a twisting mechanism for crank shaft and which can utilize an existing universal press machine by adding a few parts thereto.

BRIEF DESCRIPTION OF THE DRAWINGS

The drawings show one embodiment of the present invention.

DESCRIPTION OF THE PREFERRED EMBODIMENT

One embodiment of the present invention will now be described with reference to the drawings.

Figure 1:
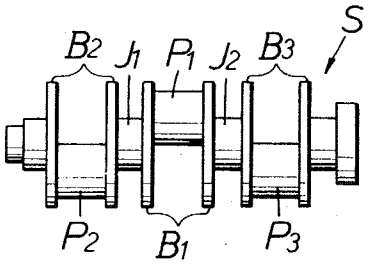
FIG. 1 is a plan view of a crank shaft.
Figure 2:
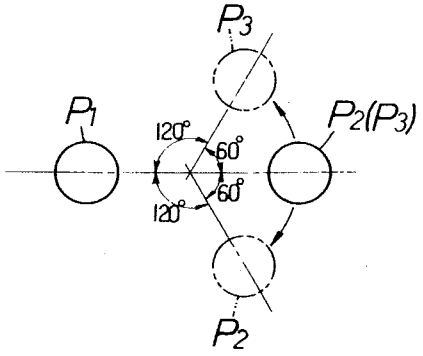
FIG. 2 is a view showing the arrangement of crank pins.

Turning now to FIG. 1, a crank shaft S to be torsional molded is, for example, for a 3-cylinder 2-cycle internal combustion engine and molded by a forging machine. Three crank pins $P_1$, $P_2$ and $P_3$ and balance weights $B_1$, $B_2$ and $B_3$ which are disposed in pairs on both sides of respective pins are arranged on the shaft through journal portions $J_1$ and $J_2$. The crank pins $P_1$, $P_2$ and $P_3$ of the crank shaft S after having been forged by the forging machine are arranged on the same plane passing through the axis of the crank shaft S, as shown in FIG. 2. A torsional apparatus in accordance with the present invention is used in order that these crank pins $P_1$, $P_2$ and $P_3$ be arranged with an angular phase of 120° offset relative to one another around the axis of the crank shaft S, which arrangement corresponds to the 3-cylinder 2-cycle internal combustion engine. That is, the crank pin $P_2$ is twisted by 60 degrees clockwise in FIG. 2, and the crank pin $P_3$ is twisted by 60 degrees counterclockwise in FIG. 2.

Figure 4:
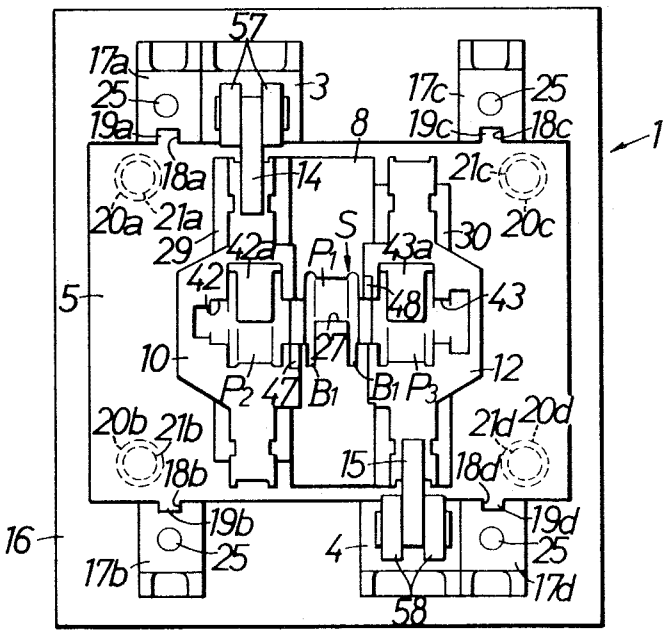
FIG. 4 is a plan view taken on line IV—IV of FIG. 3.
Figure 3:
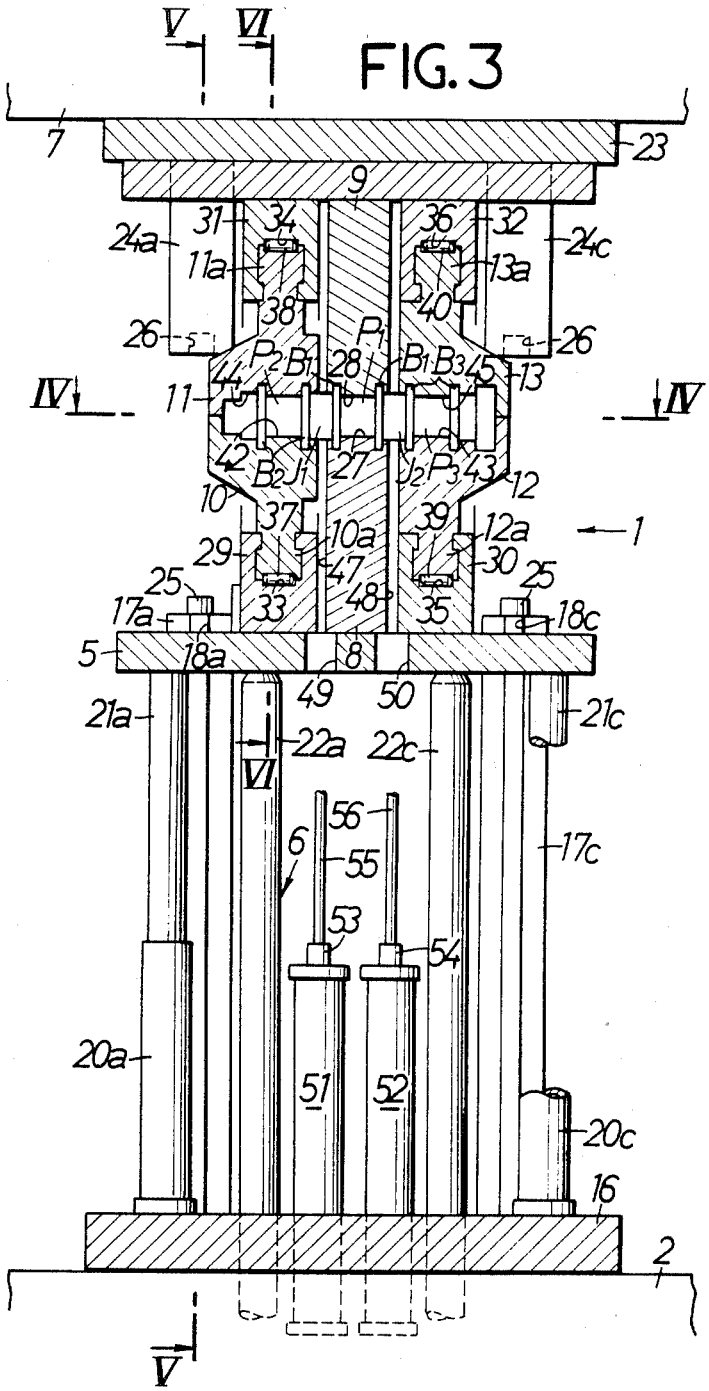
FIG. 3 is a longitudinal sectional front view of torsional molding apparatus.
Figure 5:
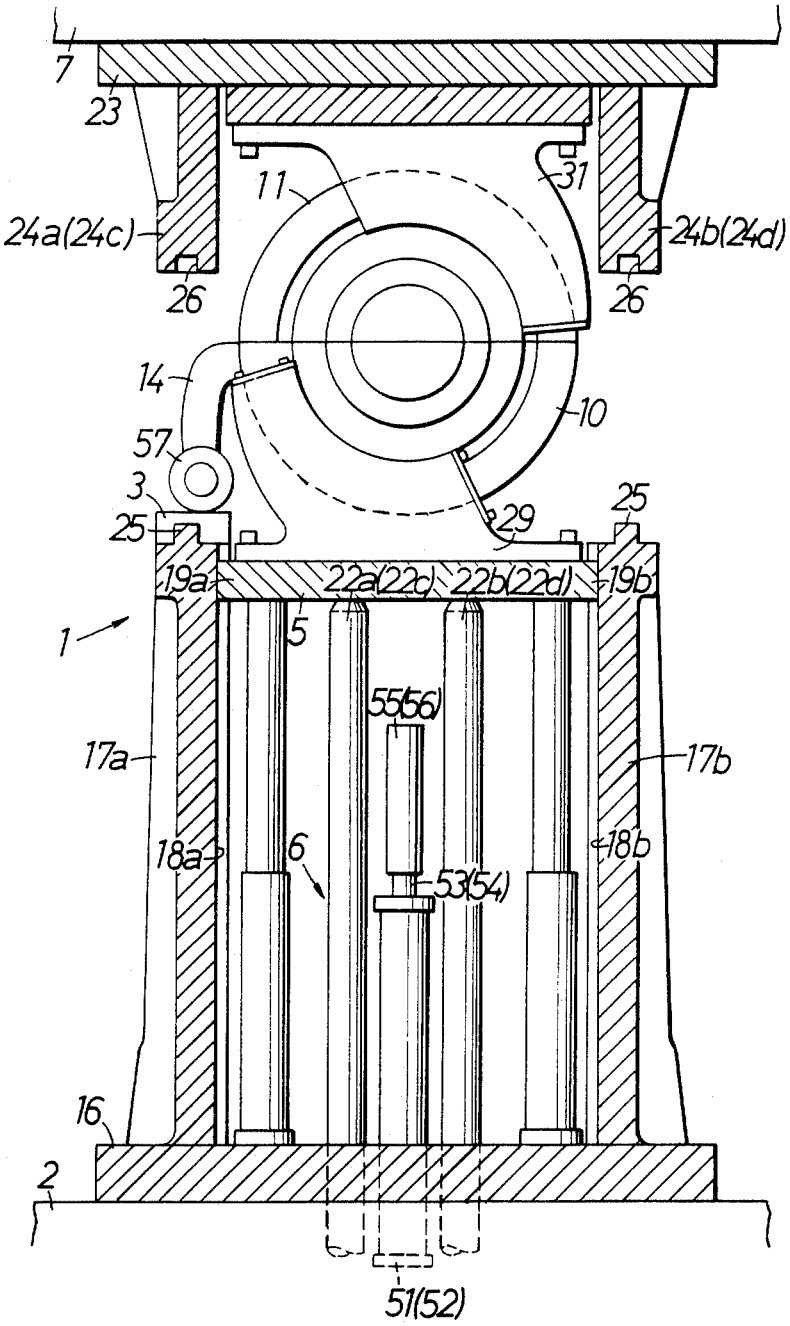
FIG. 5 is a sectional view taken on line V—V of FIG. 3.

In FIGS. 3, 4 and 5, a torsional molding apparatus 1 includes a pair of posts 3, 4 stood upright on a fixed support bed 2 and a vertically movable cushion bed 5 arranged through a resistance means 6 which resists to downward movement of the cushion bed 5. A vertically movable bed 7 which is driven to be moved up and down is arranged above the cushion bed 5. Secured to the cushion bed 5 and vertically movable bed 7 are respectively a fixed lower mold 8 and a fixed upper mold 9 which can cooperate to hold the crank pin $P_1$ part at the center of the crank shaft S. Two sets of rotatable lower molds 10, 12 and rotatable upper molds 11, 13 which can cooperate to hold the remaining crank pin $P_2$, $P_3$ parts are carried on respective beds 5 and 7 rotatably about the axis of the crank shaft S. Arms 14, 15 in abutment with the upper ends of both the posts 3, 4 are integrally projected from both rotatable lower molds 10, 12 radially and outwardly.

The fixed support bed 2 is for example a bolster of a press machine, and a lower bed 16 is integrally provided on the fixed support bed 2. Two sets of mutually opposed and paired guide posts 17*a*, 17*b*; 17*c*, 17*d* are stood upright on the lower bed 16 in spaced relation, and the cushion bed 5 is guided up and down by these guide posts 17*a*, 17*b*; 17*c*, 17*d*. That is, vertically extending guide grooves 18*a*, 18*b*; 18*c*, 18*d* are respectively bored in opposed surfaces of the paired guide posts 17*a*, 17*b*; 17*c*, 17*d*, and four projections 19*a*–19*d* to be fitted into these guide grooves 18*a*–18*d* are projected on the side of the cushion bed 5. Vertically extending four guide cylinders 20*a*–20*d* are respectively stood upright on the lower bed 16 at positiones corresponding to four corners of the cushion bed 5, and guide posts 21*a*–21*d* to be fitted into the guide cylinders 20*a*–20*d* are mounted on the lower surface of the cushion bed 5. Thus, the cushion bed 5 is guided up and down while keeping its horizontal posture upwardly of the lower bed 16.

A resistance means 6 is interposed between the fixed support bed 2 and the cushion bed 5. The resistance means comprises for example, a hydraulic cushion device, which is provided with four cushion rods 22*a*–22*d* which extend through the lower bed 16 and abut with the lower surface of the cushion bed 5 to apply a resistance, by oil pressure, to lower displacement of the cushion rods 22*a*–22*d*, that is, downward operation of the cushion bed 5. Thereby, the downward operation of the cushion bed 5 caused by pressing from the above becomes slow.

The vertically movable bed 7 is moved up and down by hydraulic apparatus not shown, and an upper bed 23 is secured to the lower surface of the vertically movable bed 7. A part of an existing press machine can be employed as this movable bed 7. Four control rods 24*a*–24*d* which extend downwardly at positions corresponding to four guide posts 18*a*–18*d* on the lower bed 16 are secured to the upper bed 23, these control rods 24*a*–24*d* being provided at their lower ends with fitting recesses 26 into which are fitted fitting projections 25 respectively projected on the upper ends of the guide posts 18*a*–18*d*. The control rods 24*a*–24*d* can be at their lower ends placed in abutment with the upper ends of the guide posts 18*a*–18*d* to thereby restrain further downward movement of the vertically movable bed 7.

That is, the lower-limit position of the vertically movable bed 7 and cushion bed 5 are controlled by the control rods 24*a*–24*d*. As a consequence, a torsional angle of the crank shaft S is determined, for example, to 60 degrees.

The fixed lower mold 8 is provided on a mold adjusting surface with a recess 27 as corresponding to the crank pin $P_1$ at the axially central portion of the crank shaft S and one side of balance weights $B_1$ on both sides thereof, and the fixed upper mold 9 is provided on its mold adjusting surface opposed to the adjusting surface of the fixed lower mold 8 with a recess 28 corresponding to the crank pin $P_1$ and the other side of the balance weights $B_1$. Thus, the central portion of the crank shaft S, that is, the portion of the crank pin $P_1$ is positively held by the fixed lower mold 8 and fixed upper mold 9 by pressing their mold adjusting surfaces toward each other.

A pair of lower rotatable support beds 29, 30 are secured to the cushion bed 5 on both sides of the fixed lower mold 8, and a pair of upper rotatable support beds 31, 32 are secured to the lower surface of the upper bed 23 on both sides of the fixed upper mold 9. One lower rotatable support bed 29 is located correspondingly to the crank pin $P_2$ of the crank shaft S, and the other lower rotatable support bed 30 is located correspondingly to the crank pin $P_3$ of the crank shaft S. One upper rotatable support bed 31 is arranged above the one lower rotatable support bed 29, and the other upper rotatable support bed 32 is arranged above the other lower rotatable support bed 30.

Figure 6:
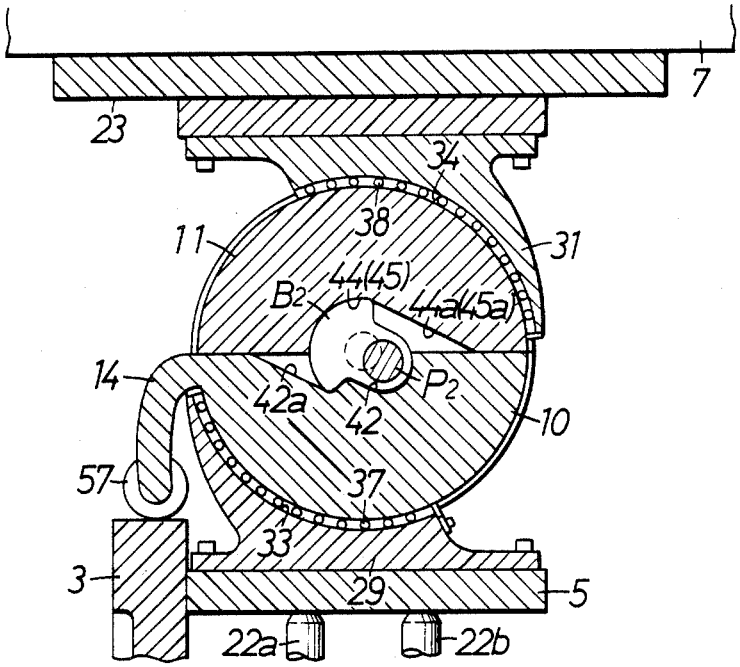
FIG. 6 is a sectional view taken on line VI—VI of FIG. 3.

In FIG. 6, the lower rotatable support bed 29 is provided with a circular guide rail 33 opened obliquely and upwardly, and the upper rotatable support bed 31 is provided with a circular guide rail 34 opened obliquely and downwardly opposing to the guide rail 33. The other lower rotatable support bed 30 is provided with a guide rail 35 opened obliquely and upwardly in a direction perpendicular to the opening direction of the guide rail 33, and the upper rotatable support bed 32 is provided with a guide rail 36 opened obliquely and downwardly opposing to the guide rail 35.

The rotatable lower mold 10 and rotatable upper mold 11, and the rotatable lower mold 12 and rotatable upper mold 13 are respectively formed into a semi-circular cylinder so that they basically form a circular cylinder when their mold adjusting surfaces are brought into contact with each other. Circular guide projections 10*a*–13*a* are respectively projected on the outer peripheries of these rotatable molds 10, 11, 12 and 13, which projections 10*a* –13*a* are fitted into guide rails 33–36 with slide bearings 37–40 interposed between its bottom and the mold. Accordingly, each of the rotatable molds 10–13 is rotatably supported by each of the support beds 29–32.

The upper surfaces of both the rotatable lower molds 10, 12, that is, their mold adjusting surfaces relative to both the rotatable upper molds 11, 13 are respectively formed with recesses 42, 43 which correspond to the crank pin $P_2$ and one side of balance weights $B_2$ on both sides, and the crank pin $P_3$ and one side of balance weights $B_3$ on both sides, respectively. The mold adjusting surfaces of both rotatable upper molds 11, 13 are respectively formed with recesses 44, 45 corresponding to the crank pin $P_2$ and the other side of balance weights $B_2$ on both sides and the crank pin $P_3$ and the other side of balance weights $B_3$ on both sides, respectively. These recesses 42–45 are formed so as not to provide an obstacle to pulling-out operation of the crank shaft S in a vertical direction after completion of torsional operation. That is, notched surfaces 42*a*, 43*a*, 44*a* and 45*a* are formed on respective recesses 42–45 in a manner that they extend vertically from portions of the recesses at which the horizontal distance from the axis is greatest at the time of completion of torsional operation. At the time of starting torsional operation as shown in FIG. 6, these notched surfaces 42*a*–45*a* do not lie on a vertical plane but are formed by estimating the positions of the recesses when the torsional operation has been completed.

Bored in the ends of both the rotatable lower molds 10, 12 on the side of the fixed lower mold 8 are grooves 47, 48 corresponding to two journal portions $J_1$ and $J_2$. Both grooves 47, 48 are formed so as to be perpendicular at the completion of torsional operation, and the upper ends of the grooves 47, 48 are positioned below the journal portions $J_1$, $J_2$. A pair of through-holes 49, 50 in communication with these grooves 47, 48 are bored in the cushion bed 5, and a pair of knock-out cylinders 51, 52 which extend vertically and correspondingly to both the through-holes 49, 50 are supported on the lower bed 16. Piston rods 53, 54 of the knock-out cylinders 51, 52 extend upwardly, and have their ends secured with flat knock-out pins 55, 56 which can come into contact with the lower portions of the journal portions $J_1$, $J_2$ by passing through the through-holes 49, 50 and grooves 47, 48.

The arms 14, 15 are integrally provided on the rotationally front side ends of respective rotatable lower molds 10, 12, and rollers 57, 58 in abutment with the upper ends of the posts 3, 4 are supported on the fore ends of the arms 14, 15.

Next, the operation of the above-described embodiment will be described. In twisting the crank shaft S, the heated crank shaft S is placed on the fixed lower mold 8 and on the rotatable lower molds 10, 12 with their mold adjusting surfaces being set on a horizontal plane in a state where the vertically movable bed 7 is at raised position. The vertically movable bed 7 is then driven to be moved down. Thereby, the crank shaft S is clamped at respective three crank pin $P_1$, $P_2$ and $P_3$ parts thereof between the fixed lower mold 8 and fixed upper mold 9; rotatable lower mold 10 and rotatable upper mold 11; and rotatable lower mold 12 and rotatable upper mold 13.

Figure 7:
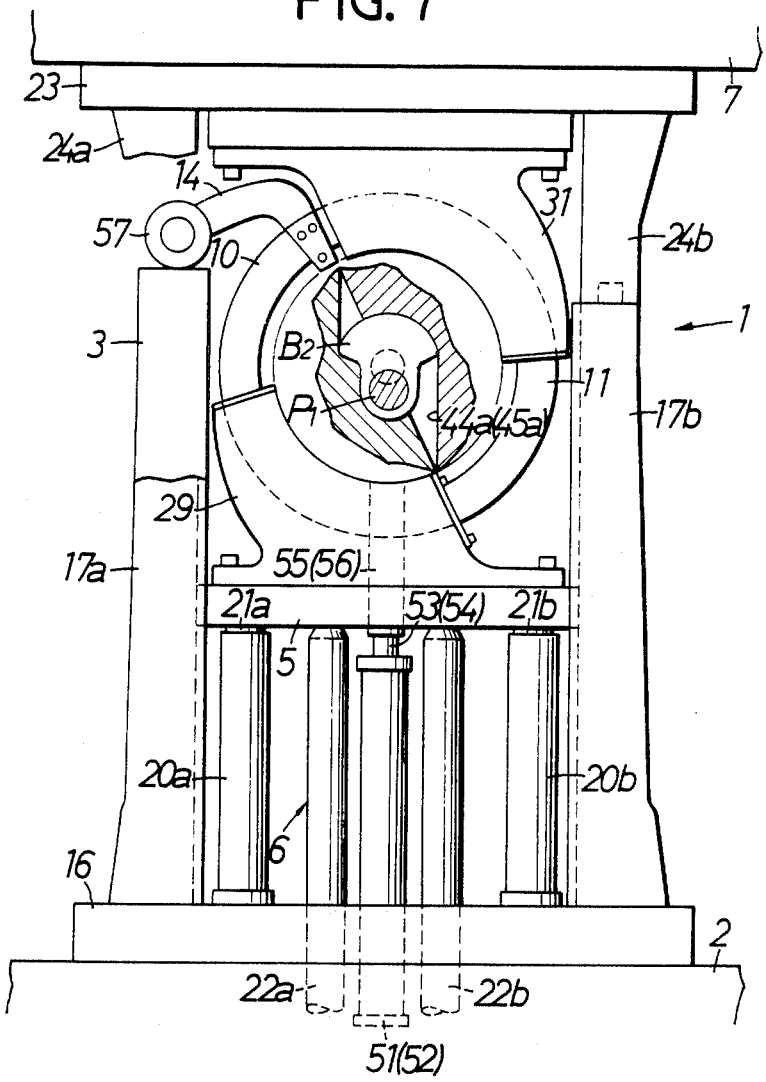
FIG. 7 is a partially cutaway side view as viewed from the left side of FIG. 3 when twisting operation is completed.

When the vertically movable bed 7 is further driven to be moved down, the cushion bed 5 is gradually moved down along with the vertically movable bed 7 due to the resistance of the resistance means 6. At this time, since rollers 57, 58 at the ends of the arms 14, 15 are in abutment with the upper ends of the posts 3, 4, as the cushion bed 5 moves down, one rotatable lower mold 10 rotates clockwise in FIGS. 5 and 6, and the other rotatable lower mold 12 rotates counterclockwise in FIGS. 5 and 6 (though not shown). Thus, the crank shaft S is twisted at the journal portions $J_1$, $J_2$. That is, when the vertically movable bed 7 moves down until the lower ends of the control rods 24*a*–24*d* come to abutment with the upper ends of the guide posts 17*a*–17*d* in a manner as described, the rotatable lower mold 10 is rotated through 60 degrees clockwise and the rotatable lower mold 12 is rotated through 60 degrees counterclockwise, as shown in FIG. 7. As a result, as shown in FIG. 2, the crank pin $P_2$ is twisted through 60 degrees clockwise from its original position, and the crank pin $P_3$ is twisted through 60 degrees counterclockwise from its original position. Thereby, a crank shaft is molded with the crank pins $P_1$, $P_2$ and $P_3$ spaced through 120 degrees from each other in the circumferential direction around the axis of the crank shaft.

Upon completion of torsional operation, the cushion bed 5 and vertically movable bed 8 are moved up to the original position, and the vertically movable bed 7 is further moved up. At this time, since the notched surfaces 44*a*, 45*a* are formed in the recesses 44, 45 of the rotatable upper molds 11, 13, the fitting between the rotatable upper molds 11, 13 and crank shaft S is easily released in line with upward movement of the vertically movable bed 7. Next, the knock-out cylinders 51, 52 are driven to be extended to displace the knock-out pins 55, 56 upwardly into abutment with the lower portions of the journal portions $J_1$, $J_2$, which journal portions are then pushed up to enable the crank shaft S to be pulled out of the fixed lower mold 8 and both rotatable lower molds 10, 12. At this time, owing to the notched surfaces 42*a*, 43*a* on the recesses 42, 43 as extending vertically, there exists no obstacle to pulling out operation of the crank shaft S.

After removal of the crank shaft S, the rotatable upper molds 11, 13 are rotated to return to their original positions by drive means such as a cylinder or motor not shown, while the rotatable lower molds 10, 12 are rotated to go back to their original positions with use of no specific drive means since the rollers 57, 58 at the tip ends of the arms 14, 15 integrally formed on the molds 10, 12 can serve as weight therefor. Thus, torsional operation of the crank shaft S is completed.

While in the above-described embodiment, a description has been made of a torsional apparatus for crank shaft for use with a 3-cylinder 2-cycle internal combustion engine, it should be noted that the present invention can be practicised irrespective of the number of engine cylinders. While the rotatable axes of the rotatable molds 10–13 have been one and the same, those axes can be located selectively in correspondence to the torsional portion, that is, to the journal portion, if necessary.

As described above, according to the present invention, the posts are stood upright on the fixed support bed, the vertically movable cushion bed is arranged on the fixed support bed through a resistance means which resists to downward operation of the cushion bed, the vertically movable bed adapted to be driven for vertical displacement is arranged upwardly of the cushion bed, the fixed lower mold and fixed upper mold adapted to cooperate together to hold a certain crank pin part are secured to the cushion bed and vertically movable bed, respectively, the rotatable lower mold and rotatable upper mold adapted to cooperate together to hold the other crank pin part are carried on respective cushion bed and vertically movable bed rotatably about the axis of the crank shaft, and the arms in abutment with the upper ends of the posts are integrally projected radially and outwardly from the rotatable lower mold. Therefore, the rotatable upper mold and rotatable lower mold are rotated in accordance with the downward operation of the vertically movable bed. Accordingly, the aforesaid other crank pin part is twisted with respect to the certain crank pin part. As a result, the clamp mechanism and torsional mechanism need not be provided separately, and thus the structure can be simplified and miniaturized. Moreover, a conventional universal press machine can be utilized merely by adding molds, arms, posts and the like.

What is claimed is:

1. A torsional molding apparatus for use on a press having a fixed support bed, a movable bed above said fixed support bed and movable toward and away from said fixed support bed and means for moving said movable bed toward and away from said support bed and for use in positioning each crank pin of a crank shaft at a predetermined angular position relative to the other crank pins on the crank shaft having a plurality of crank pins arranged on the same plane passing through the axis of the crank shaft, said torsional molding apparatus comprising: upright posts on said fixed support bed having upper ends fixed relative to said support bed, a movable cushion bed intermediate said fixed support bed and said movable bed, resistance means mounting said movable cushion bed on said fixed support bed and resistant to downward movement of said cushion bed toward said fixed support bed, a fixed lower mold secured to said cushion bed, a fixed upper mold in alignment with said fixed lower mold and secured to said movable bed and in mating cooperation with said fixed lower mold for engaging a first selected crank pin therebetween, a rotatable lower mold secured to said cushion bed and rotatable upper mold in alignment with said rotatable lower mold and secured to such movable bed and in mating cooperation with said rotatable lower mold for engaging a second selected crank pin therebetween, said rotatable lower mold and said rotatable upper mold being rotatable relative to said fixed lower and upper molds and to the axis of said crank shaft, an integral arm projecting radially and outwardly from one of said rotatable molds, said arm being in abutment with the upper end of one of said posts, said arm, in abutment with the upper end of said post torsionally rotating said rotatable upper and lower molds relative to said fixed lower and upper molds and to the axis of said crank shaft as said movable press bed is moved toward said fixed support press bed and said cushion bed therebetween and said cushion bed is moved toward said fixed support press bed against the resistance of said resistance means, said torsionally rotating rotatable upper and lower molds angularly displacing said second selected crank pin relative to said first selected crank pin angular of said crank shaft axis.

2. A torsional molding apparatus as defined in claim 1, wherein mutually opposed mold adjusting surfaces of said rotatable lower mold and rotatable upper mold are respectively provided with recesses for fitting with respective crank pin parts, said recesses being formed to allow the crank shaft to be removed vertically after completion of torsional rotation.

3. A torsional molding apparatus as defined in claim 1, wherein as said fixed support bed and said vertically movable bed are components of an existing universal press machine.

4. A torsional molding apparatus as defined in claim 1, wherein said integral arm has a roller for abutment with said upper end of said post, said roller serving as a weight for forcing said rotatable lower mold, after a completed crank shaft is removed therefrom, to return to its original horizontal position.

5. A torsional molding apparatus as recited in claim 1, comprising a plurality of pairs of aligned and mating rotatable lower and upper molds, each of said pairs being engageable with a selected crank pin and being rotatable relative to the axis of said crank shaft by the abutment of the arm thereon with the upper end of one of the said posts to torsionally rotate the rotating molds of said pairs of molds and to angularly displace the crank pin engaged therebetween.

* * * * *